US005766072A

United States Patent [19]

Andersson

[11] Patent Number: 5,766,072

[45] Date of Patent: Jun. 16, 1998

[54] VENTILATION ARRANGEMENT, INCLUDING FILTER CONSTRUCTED AS SOUND DAMPENER, FLOW DAMPER AND FOR FILTERING PURPOSES

[75] Inventor: Per Otto Andersson, Bromma, Sweden

[73] Assignee: P.O. Andersson Konstruktionsbyra AB, Solna, Sweden

[21] Appl. No.: 605,173

[22] PCT Filed: Sep. 8, 1994

[86] PCT No.: PCT/SE94/00833

§ 371 Date: Mar. 11, 1996

§ 102(e) Date: Mar. 11, 1996

[87] PCT Pub. No.: WO95/08084

PCT Pub. Date: Mar. 23, 1995

[30] Foreign Application Priority Data

Sep. 15, 1993 [SE] Sweden ..... 9303002

[51] Int. Cl.[6] ..... F24F 3/16

[52] U.S. Cl. ..... 454/252; 55/385.2; 55/467

[58] Field of Search ..... 454/232, 252, 454/251, 333, 338; 55/270, 385.2, 467

[56] References Cited

U.S. PATENT DOCUMENTS

| | | | |
|---|---|---|---|
| 1,052,450 | 2/1913 | Berglund | 454/252 |
| 3,180,363 | 4/1965 | Knarbakk | 454/333 X |
| 3,458,130 | 7/1969 | Juhlin | 454/232 X |
| 3,465,666 | 9/1969 | Knab | 454/251 X |
| 3,714,884 | 2/1973 | Christiansen | 454/310 |
| 4,150,696 | 4/1979 | Meier et al. | 138/44 |
| 5,313,803 | 5/1994 | Detzer | 62/89 |

FOREIGN PATENT DOCUMENTS

| | | | |
|---|---|---|---|
| 0 466 669 | 1/1992 | European Pat. Off. . | |
| 57-74532 | 5/1982 | Japan | 454/251 |
| 434 466 | 7/1984 | Sweden . | |
| 435 101 | 9/1984 | Sweden . | |
| 444 852 | 5/1986 | Sweden . | |
| 451 111 | 9/1987 | Sweden . | |
| 91/14138 | 9/1991 | WIPO . | |

*Primary Examiner*—Harold Joyce

*Attorney, Agent, or Firm*—Jacobson, Price, Holman & Stern, PLLC

[57] ABSTRACT

A ventilation plant comprising fans for distribution of intake air and exhaust air in branch ducts having openings for the intake air and exhaust air. Tubular filters are sealingly attached to the openings and create a pressure drop of about 200 Pascal, which filters at flow velocities adjusted to about 2–5 m/s are acting also as throttling and sound damping devices of the plant.

6 Claims, 1 Drawing Sheet

FIG.1

FIG.2

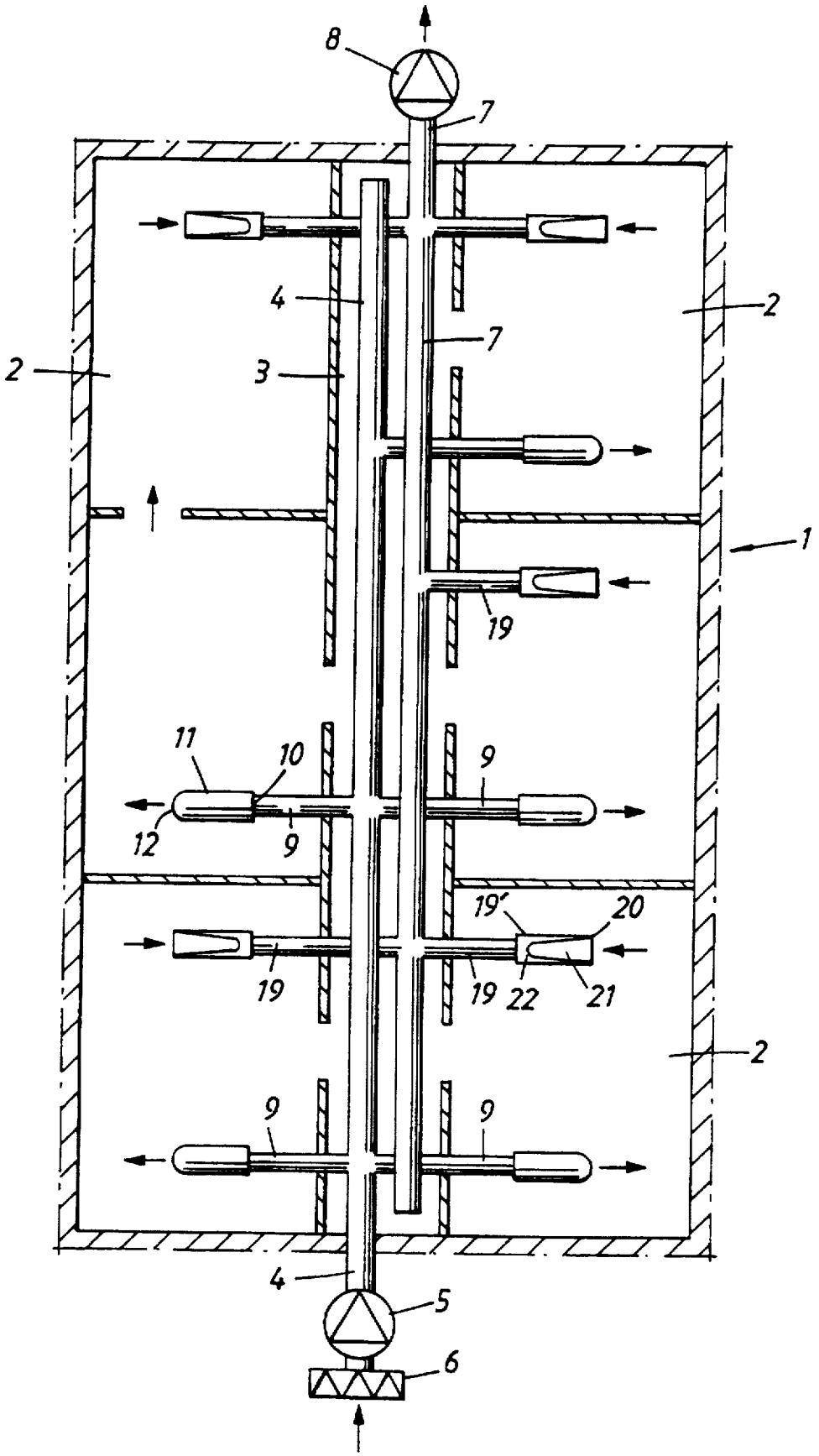
8
7
4
2
7
2
3
1
19
11
10
9
12
9
19'
20
19
19
22
21
2
9
9
4
5
6

VENTILATION ARRANGEMENT, INCLUDING FILTER CONSTRUCTED AS SOUND DAMPENER, FLOW DAMPER AND FOR FILTERING PURPOSES

BACKGROUND OF THE INVENTION

1. Field of the Invention

The present invention relates to a ventilation plant comprising fans for distribution of intake air and exhaust air in branch ducts, devices for balancing the air flows through the branch ducts by means of throttling devices positioned in the ducts, devices for filtering the air, and sound damping devices.

2. Description of the Related Art

Plants of this type usually are provided with filter boxes positioned in the ducts and containing laterally replaceable filter units. Measures are taken there that the filters are causing as low pressure drops as possible in order not to load the fans unnecessarily. Therefore, the filter units have a complicated design with a large area in spite of a limited space resulting in difficulties in connection with sealing members which have a tendency to by-pass air unfiltered. The boxes are also space consuming. Moreover, throttling devices in the shape of adjustable valves in the ducts are necessary. The mounting of these and the adjusting of them to proper balancing of the air flows in the ducts is a considerable complication and a time consuming work.

SUMMARY OF THE INVENTION

The object of the invention is to achieve a ventilation plant of the kind initially mentioned in which the drawbacks mentioned above are eliminated, and which is specially suited for systems with extremely heavy demands for purity and functioning, and, as a consequence, simple and sufficient inspection possibilities, as for example in laboratory buildings and animal-occupied spaces.

This has been achieved, according to the invention, by the fact that in the different spaces the duct openings for intake air and for exhaust air are provided with tubular, thick-walled filters providing a pressure drop of such a magnitude, preferably of about 200 Pascal, that at properly adjusted flow velocities at the openings, preferably of about 2–5 m/sec, the filters are acting also as the throttling devices and the sound damping devices of the plant.

A solution to the problems of balancing air flows and the damping of the usually strong noise occurring when the air flows through the throttling devices in conventional plants has been achieved by the invention by a simple measure, which is completely against accepted or standard rules. Filters are installed having an interior or a built-in pressure drop of a magnitude making the installation of conventional throttling devices and accordingly also conventional sound-damping devices superfluous. Air flows noise lessly through the filters. The are positioned in the spacings at the openings for intake air and exhaust air, and specific throttling devices and sound damping devices are eliminated, so that the interior of the duct system becomes free from pollution as well as devices disturbing the air flow. Moreover, different spacings become separated from each other by the filters such that, for instance, disease carrying particles are prevented from being spread between different spacings, because normally the filters are of such a grade that disease carrying particles cannot penetrate the filters. The filters also act as sound-damping means between different spacings. The placing of the filters simplifies the important changing of the filters, which can be made out of fire-resistive material that can resist high temperatures without being destroyed, at least under the temperature circumstances existing in connection with release of a sprinkler system in case of fire.

BRIEF DESCRIPTION OF THE DRAWING

The invention will become more readily apparent from the following description, reference being made to the accompanying drawing showing a simplified diagram of a ventilation plant in a building.

DETAILED DESCRIPTION OF THE PREFERRED EMBODIMENT

The drawing discloses a building 1 with a number of room spaces 2. A straight duct 4 for intake air is suspended from the ceiling of a corridor 3 and connected to a fan 5 provided with a conventional filter 6. In parallel to the duct 4 there is a duct 7 for exhaust air connected to a fan 8.

A branch duct 9 from the duct 4 for intake air communicates each with a room spacing, which branch ducts are terminated each by an opening 10 to which a tubular filter 11 provided with a closed end 12 is sealingly attached. A branch duct 19 from the duct 7 for exhaust air communicates each with a room spacing, which branch ducts are terminated with a section 19' having a slightly larger area than the branch duct 19 and an opening 20 to which a tubular filter 21 is sealingly attached, which is slightly narrowing towards a closed end 22. The filter 21 extends into the section 19' along mainly its entire length and is protected by it. The filters 11, on the other hand, are positioned in the open air, which is possible because they are stiff enough and the contamination occurs inside the filters. If desired, however, a casing may be attached outside the filters as an extension of the branch ducts 9 and having a slightly larger area than the branch ducts 9.

Filter devices 11 and 21 are a type of tubular filter bags which have an interior or built-in pressure drop of about 200 Pascal, and which are designed to prevent penetration of the smallest particles. Filter devices having a slightly larger or smaller pressure drop can be utilized for achieving the proper balance. The filter devices are easily mounted. The open end is attached to the end portion of a branch duct 9 or a section 19', in which latter case the filter 21 is pushed into the interior of the section 19'.

The invention is of course not limited to the embodiment shown and described above, but can be modified in different ways within the scope of the inventive idea defined by the claims.

I claim:

1. A ventilation plant comprising branch ducts for intake air and exhaust air, room spaces, and fans for distribution through said branch ducts of the intake air to said room spaces and of the exhaust air from said room spaces, and provided with means for balancing the air flows through said branch ducts by throttling means associated with the ducts, the improvement comprising branch ducts having outlet openings for distributing intake air to the room spaces and inlet openings for removing exhaust air from the room spaces, and easily replaceable tubular filter bags covering each of said outlet and inlet openings, the filter bags having built-in pressure drops necessary for acting as the throttling means of the ventilation plant.

2. A ventilation plant as claimed in claim 1, wherein the pressure drops of the filter bags are about 200 Pascal at flow velocities adjusted to about 2–5 m/sec. at the openings.

3. A ventilation plant for ventilating air for a plurality of room spaces, which comprises a main intake air duct and a main exhaust air duct; intake air branch ducts connected to said main intake air duct and having outlet openings for conveying intake air to said room spaces; exhaust air branch ducts connected to said main exhaust air duct and having inlet openings for conveying exhaust air from said room spaces; fans for distributing intake air and exhaust air in said intake and exhaust air branch ducts, respectively; and tubular filters having built-in pressure drops covering said outlet openings and said inlet openings for filtering said intake air and said exhaust air and simultaneously throttling said intake air and said exhaust air in order to balance air flow through each of said intake and exhaust air branch ducts and dampen noise of air flowing therethrough.

4. A ventilation plant as claimed in claim 3, wherein the filters provide pressure drops of about 200 Pascal and flow velocities of about 2–5 m/sec. at each of said inlet and outlet openings.

5. The ventilation plant of claim 3, wherein the intake air flows unobstructed through said main intake air duct and said intake air branch ducts and exhaust air flows unobstructed through said main exhaust air duct and said exhaust air branch ducts.

6. The ventilation plant of claim 3, wherein said filters are mounted on the outside of said ducts for easy replacement and expand in the direction of air flow.

* * * * *